US007252567B2

(12) United States Patent
Roos

(10) Patent No.: US 7,252,567 B2
(45) Date of Patent: Aug. 7, 2007

(54) METHOD FOR FORMING/INSTALLING INTAKE DUCT IN WATERJET-PROPELLED MARINE VESSEL

(75) Inventor: Paul W. Roos, Delray Beach, FL (US)

(73) Assignee: Apex Hydro Jet, LLC, Delray Beach, FL (US)

( * ) Notice: Subject to any disclaimer, the term of this patent is extended or adjusted under 35 U.S.C. 154(b) by 0 days.

(21) Appl. No.: 11/240,023

(22) Filed: Sep. 30, 2005

(65) Prior Publication Data

US 2006/0073746 A1 Apr. 6, 2006

Related U.S. Application Data

(60) Provisional application No. 60/615,090, filed on Oct. 1, 2004.

(51) Int. Cl.
*B63H 11/00* (2006.01)

(52) U.S. Cl. ..... 440/38

(58) Field of Classification Search ..... 440/38, 440/40, 41, 42, 43, 46
See application file for complete search history.

(56) References Cited

U.S. PATENT DOCUMENTS

| | | | | |
|---|---|---|---|---|
| 3,823,683 | A * | 7/1974 | Usborne | 440/41 |
| 3,840,319 | A * | 10/1974 | Rhoda | 425/470 |
| 4,276,035 | A * | 6/1981 | Kobayashi | 440/47 |
| 5,401,198 | A | 3/1995 | Toyohara et al. | |
| 5,480,330 | A * | 1/1996 | Brown | 440/38 |
| 5,720,635 | A | 2/1998 | Roos | |

* cited by examiner

*Primary Examiner*—Sherman Basinger
(74) *Attorney, Agent, or Firm*—Jansson Shupe & Munger Ltd.

(57) ABSTRACT

A waterjet-propelled marine vessel having a hull with a transom and a bottom, a jet pump, and an intake duct, the improvement comprising: (1) the transom and bottom having a common opening for intake duct installation and (2) the intake duct having an intake duct upper part and an intake duct lower part, whereby the intake duct upper part closes the common opening and the intake duct lower part fits into the intake duct upper part to form the intake duct.

10 Claims, 9 Drawing Sheets

INTAKE DUCT SHELL ASSEMBLY PLACED IN VESSEL MOLD

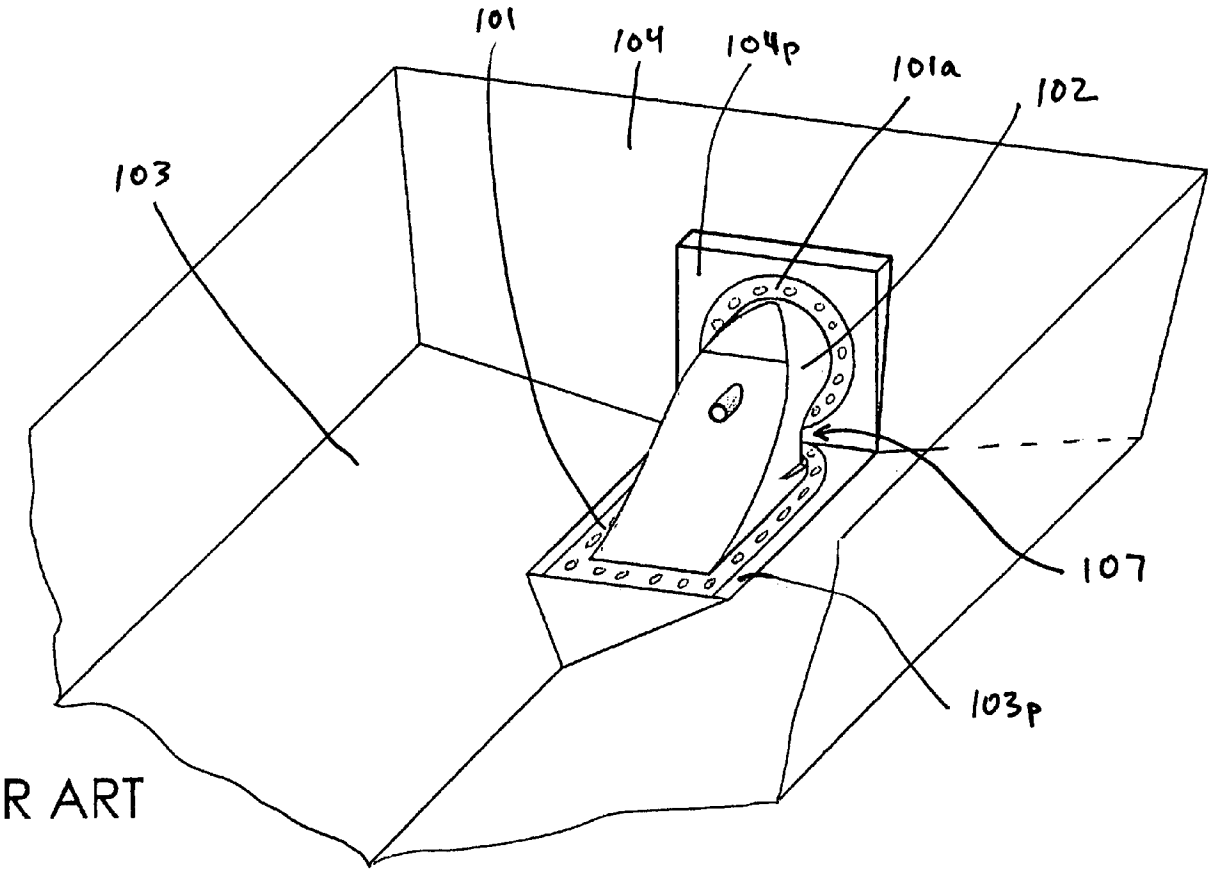
PRIOR ART
FIG. 1A CONVENTIONAL FLANGED AND BOLTED INTAKE DUCT

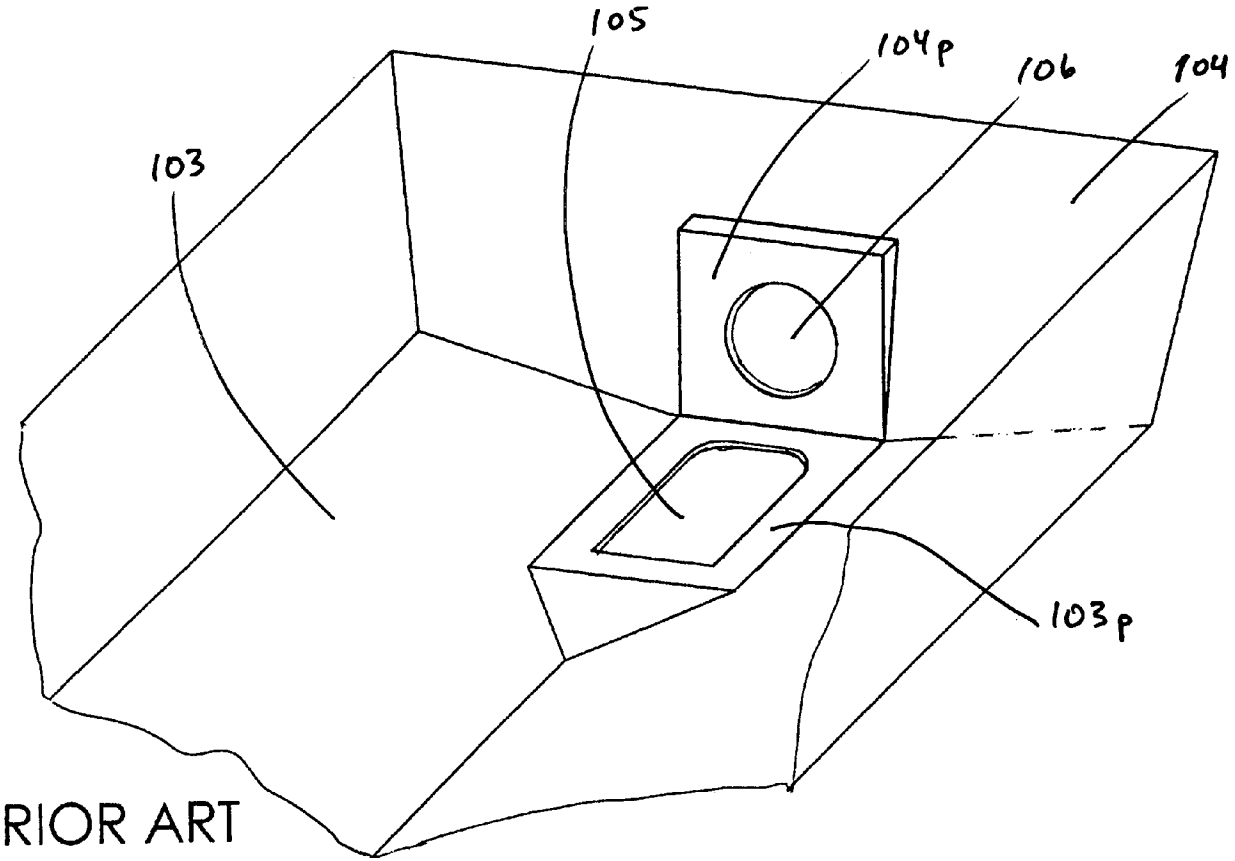
PRIOR ART
FIG. 1B BOTTOM AND TRANSOM OPENINGS IN VESSEL HULL

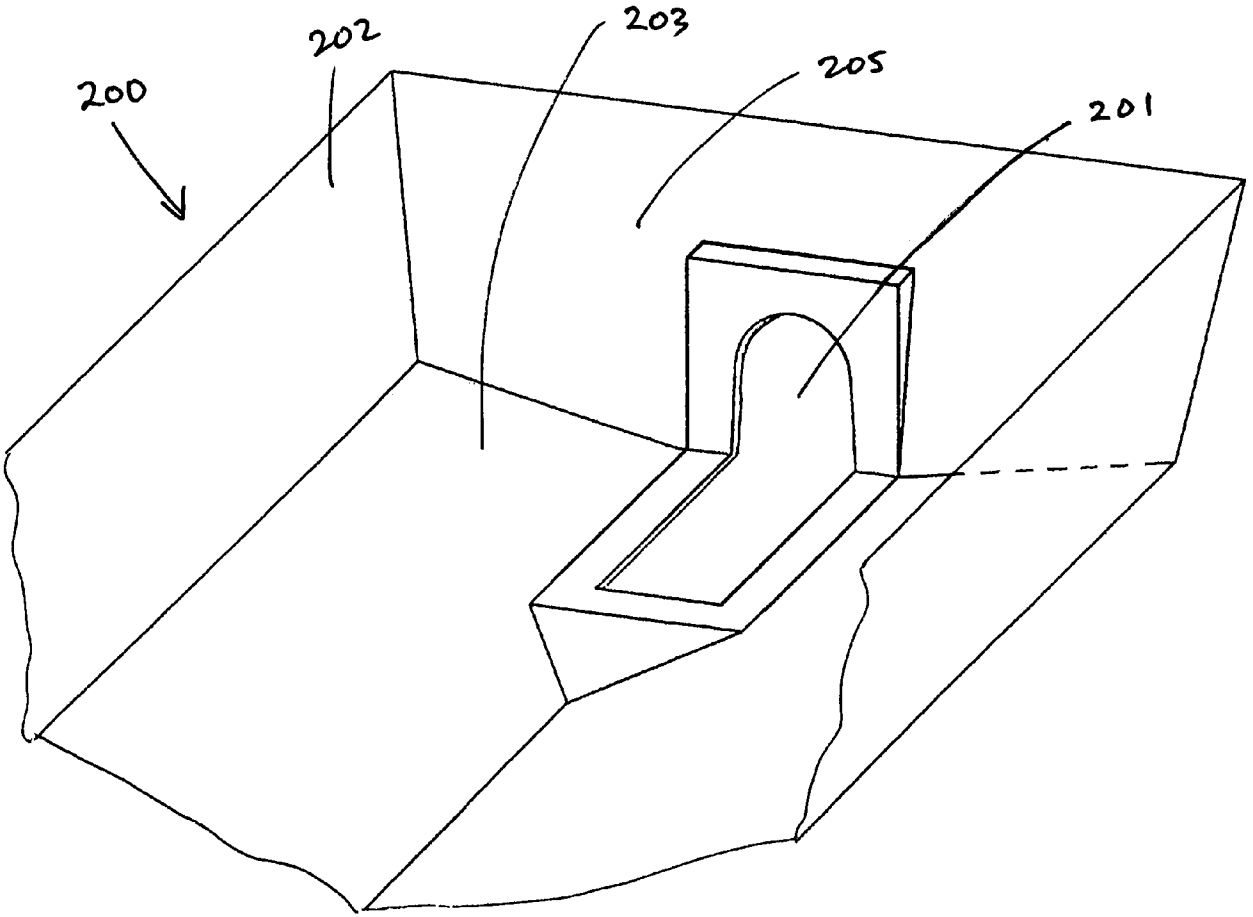
FIG. 2A COMMON BOTTOM AND TRANSOM OPENING IN VESSEL HULL

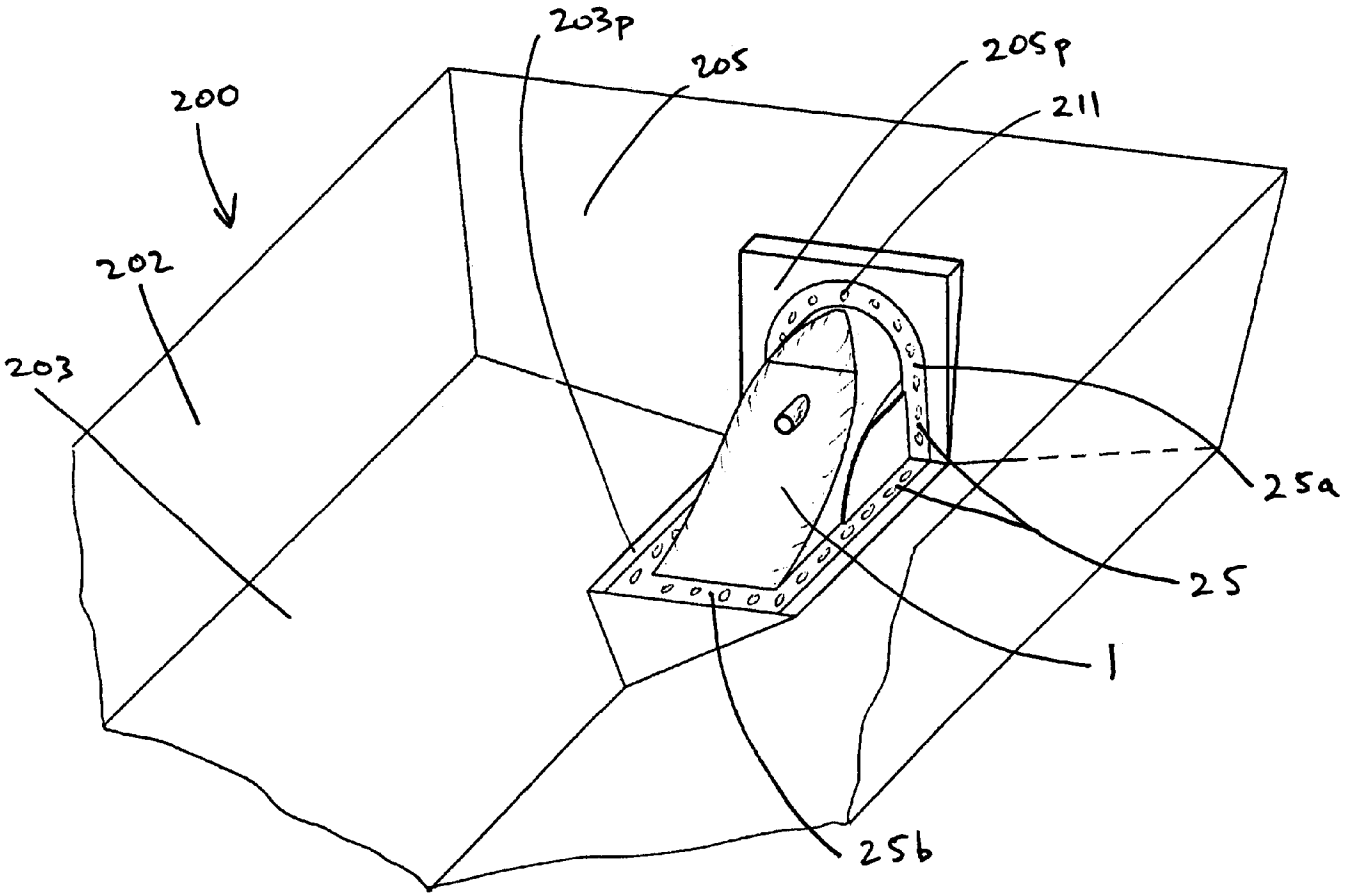
FIG. 2B INTAKE DUCT INSTALLED OVER COMMON OPENING

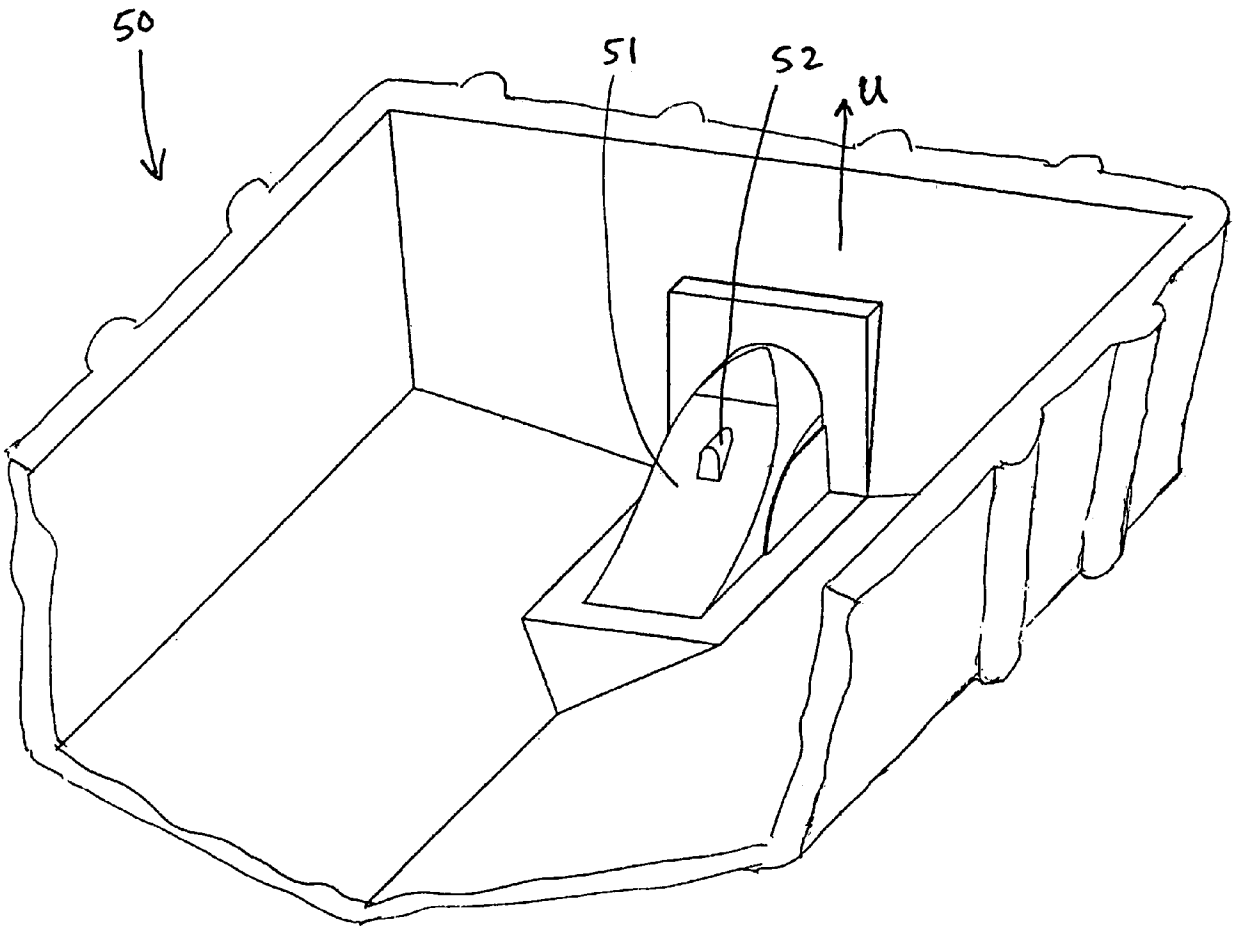
FIG. 6 PLUG FOR INTAKE DUCT UPPER PART IN VESSEL MOLD

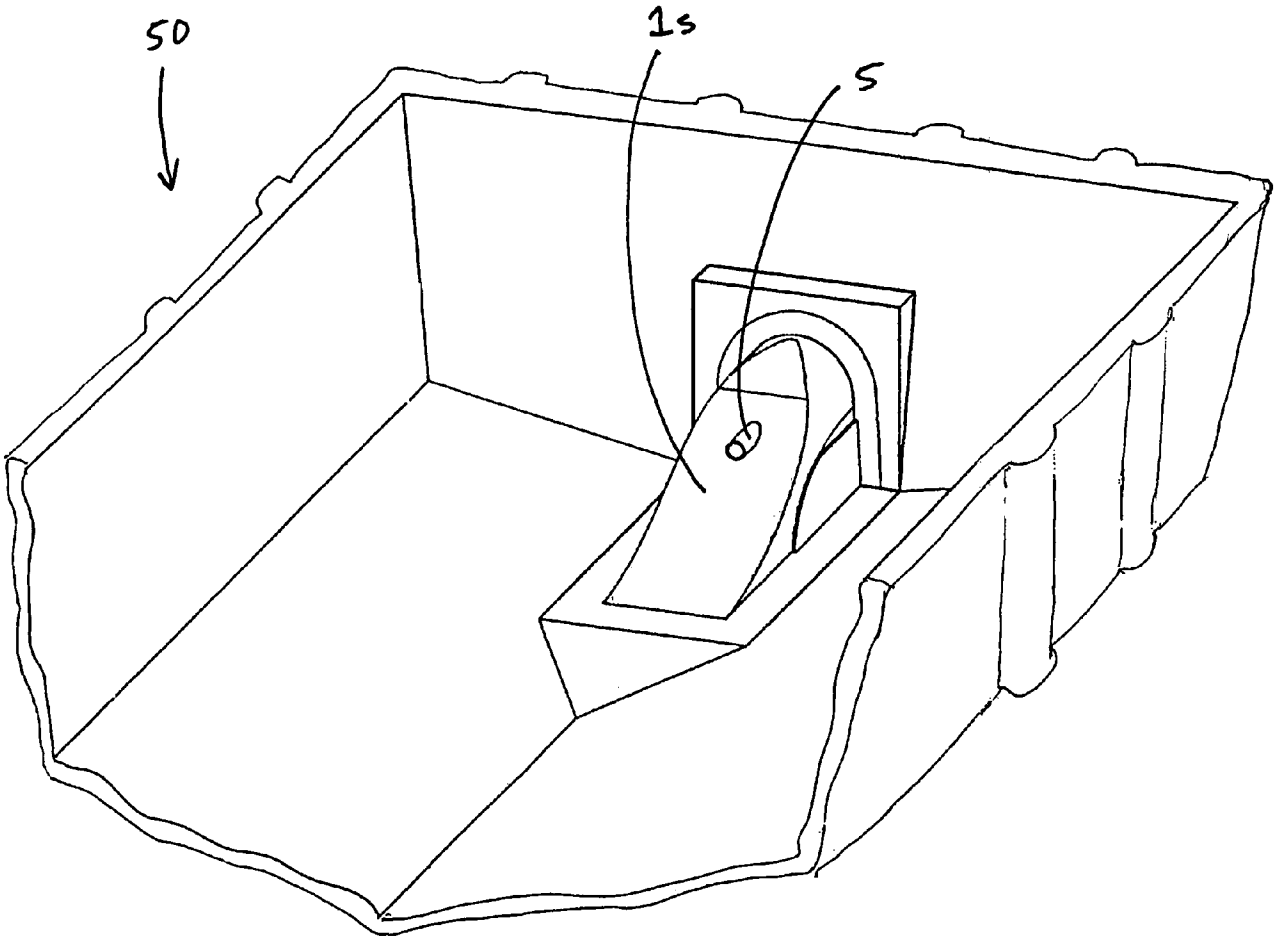
FIG. 7 INTAKE DUCT SHELL ASSEMBLY PLACED IN VESSEL MOLD

METHOD FOR FORMING/INSTALLING INTAKE DUCT IN WATERJET-PROPELLED MARINE VESSEL

RELATED APPLICATION

This application is based on U.S. Provisional Application No. 60/615,090 filed on Oct. 1, 2004, the contents of which are incorporated herein by reference.

FIELD OF THE INVENTION

This invention relates to a waterjet driven marine vehicle, and more particularly the installation method of a waterjet in a marine vehicle.

BACKGROUND OF THE INVENTION

Marine waterjets have many advantages over other means of propelling a marine vessel, such as shallow draft, greater safety and higher efficiency. However, a disadvantage is the time-consuming process of installing the intake duct of the waterjet into the vessel hull.

An example of such a conventional marine jet drive installation is seen in FIG. 1A (labeled PRIOR ART). The traditional method of installation involves the use of overlapping and bolted bottom flange 101 and transom flange 101*a* around the interface between a waterjet intake duct 102 and a vessel bottom protrusion 103*p* in a vessel bottom 103 and a transom protrusion 104*p* in a transom 104. In FIG. 1B (also labeled PRIOR ART), a bottom opening 105 in bottom 103 and a transom opening 106 in transom 104 have to be laid out and cut in each vessel for each waterjet unit, making the production of the openings a labor-intensive process.

The placement procedure of the intake duct in the vessel hull is complicated and labor-intensive since the flanges of the intake duct of the waterjet have to be matched in two substantially perpendicular planes and be provided with sealer and fastener holes for attachment to protrusions 103*p* and 104*p* to produce the mechanical strength of the interface necessary to transmit the thrust and the steering and reversing forces generated by the waterjet, all while maintaining water-tight joints. Additionally, access to the bottom and transom bolts, especially in the undercut area (indicated by reference number 107 in FIG. 1A) below the lower intake duct wall, is limited and requires special tools.

It is not possible to efficiently produce a vessel with this traditional installation method of cutting, mating, sealing and bolting bottom and transom flanges with limited access in the interior of the vessel. Conventional waterjet intake ducts are made of metal, and the use of bolted mounting flanges is the common method of installing an intake duct in a vessel made of similar or dissimilar material in a new vessel or in a retro-fit installation. The cost of metallic intake ducts is high, and they are heavy and corrosion is a constant problem.

A second approach used in the production of composite hulls for waterjet applications places mold inserts in the hull mold prior to lay-up to produce the intake duct openings in the hull bottom and transom. This only avoids the layout and cutting of bottom and transom openings in the hull but still requires the labor-intensive bolted flange installation described in the paragraph above.

A third approach involves the manufacture of a composite intake duct with flanges for installation in non-composite vessel hulls and in retro-fit applications, but again, this is similarly complicated because of the complex geometries as described above.

In a fourth approach to installing an intake duct into a composite vessel hull, a waterjet intake duct plug is placed in the vessel mold as a method of producing the intake as part of the hull in the hull fabrication process. The intake duct contains an undercut in the mold shape, thus preventing release of the hull with the newly-formed intake duct. To accomplish release from the mold requires a permanent hull mold modification to allow retraction of the interfering mold parts, or, the removal and destruction of a sacrificial plug. In addition, the vessel lay-up process is considerably more complicated and time-consuming. A permanently modified hull mold precludes use of the same mold for non-waterjet hull production.

The present invention simplifies the manufacture of the intake duct, producing a flanged version for dissimilar hull material vessels or retro-fit applications and allows in-place molding of the intake duct in composite vessels. The invention solves the common problems of the four installation approaches described above. The preferred material of construction is composite to avoid the weight, corrosion and cost of metallic intake ducts. This simplification involves the manufacture of the intake duct in a manner that avoids the undercut that prevents a straight release from the mold. It is accomplished by separating the intake duct into an upper part and a lower part that each separately have no undercut so that each part can be made in a mold that permits the straight release of the part without the need for removal of a mold component that would form an undercut.

The hull bottom and transom openings are connected by the removal of the section directly between the two openings, thereby creating a common opening in the transom and hull bottom and eliminating the portion of the bottom opening and transom opening that are difficult to reach when bolting the separate bottom and transom flanges.

The upper part of the intake duct forms the upper wall with the mounting provision for the intake grid and the support of the shaft tube. It has a register to receive the lower part of the intake duct to locate it in a unique, fixed position in relation to the upper part of the intake duct. The lower part of the intake duct forms the trailing edge of the intake opening and also forms the lower wall of the intake duct. The lower part of the intake duct has a mating register to mate with the upper part. In combination, the two parts also form the surface and register for mounting the jet pump section to the discharge end of the intake duct at the transom.

In a first embodiment, the concept can be used for intake duct manufacture for applications with non-composite hulls made of metal or wood or to retro-fit existing vessels to simplify the first and second conventional approaches as described above. The flanged version of the intake duct of the present invention simplifies installation by avoiding the need for separate matching openings in the bottom and transom while also avoiding the need to place flange bolts in a difficult-to-reach location. An upper part plug is used to produce a full-thickness upper part and is provided with mounting flanges. Attachment of the lower part of the intake duct produces a complete intake duct with flanges that are continuous between bottom and transom. Hull preparation is simplified since the bottom and transom cut-outs become a common opening with one continuous seam and not two separate openings, thereby eliminating the holding of critical dimensions between transom and bottom openings. Even though the sealing and bolting processes are necessary, they are less time-consuming than a conventional installation since the bolts are all easily accessible and not hidden by undercut 107 (see FIG. 1A) of the conventional intake duct. The flange runs continuously from one side of the intake to the transom and then up and over to the other side, following the contour of the opening. The installation process for dissimilar hull materials and retro-fits is made significantly simpler.

In a second embodiment, which simplifies the third and fourth conventional approaches, a formed-in-place version of the intake duct avoids the flanged connections altogether by eliminating the flanges and molding the upper part of the intake duct directly into the hull. In this embodiment, the mold producing the upper part is now placed in the vessel mold and produces in a single lay-up process the hull with the upper part of the intake duct in place while the vessel is releasable from the mold. The lower part of the intake duct is produced in a separate mold and is inserted into the upper part of the intake duct after the hull is removed from the mold, thus forming the complete intake duct. A shaft tube is then added to complete the installation of this embodiment.

In a third embodiment of the invention, again simplifying the third and fourth conventional approaches, a shell of the upper part of the intake duct with a shaft tube in place is molded on a plug. The shell is just thick enough to maintain the shape of the upper part. The shell of the upper part of the intake duct is then mated with the fully-formed lower part thereby forming the complete intake duct shape. This combination of the shell of the upper part and the fully-formed lower part is placed in a hull mold. When the vessel is laid-up over the upper part intake duct shell with the lower part in place, the shell bonds to the lay-up and becomes a part of the hull, thus providing a completely installed waterjet intake duct upon removal of the vessel from the vessel mold. The advantage of this method is that the intake can be pre-manufactured with the shaft tube of the jet pump in place, and the mounting surface for the jet pump can be fully inspected prior to installation. Upon delivery of the intake shell to the vessel builder, it can be placed in the hull mold and, when laid-up, the intake will be an integral part of the vessel.

All embodiments of the invention provide simplified installation of a waterjet intake duct. In applications with dissimilar material (hull and intake duct) and in retro-fit applications, installation time is shortened and in a laid-up composite vessel, as part of the manufacture of the hull, very little time is added to the manufacturer's building process.

OBJECTS OF THE INVENTION

An object of the present invention is the simplification of the production of a waterjet intake duct, including both part manufacture and overall assembly.

It is also an object of this invention to eliminate the high cost, high weight and corrosion associated with metallic intake ducts.

It is a further object of this invention to eliminate the labor-intensive and cumbersome intake installation procedure in composite hulls.

Another object of the invention is to produce hulls with intake ducts provided as part of the hull lay-up process.

Yet another object is to enable pre-fabrication and inspection of intake ducts before installation.

Another object of this invention is to provide a shaft tube as an integral part of the intake duct or as a separately installable unit.

A further object is to provide an intake duct which is completely moldable without undercuts.

These and other objects of the invention will be apparent from the following detailed descriptions and from the drawings.

SUMMARY OF THE INVENTION

The term "undercut" as used herein refers to the portion of a part that when produced using a mold, prevents the release from the mold without first removing a portion of the mold in order to release the part from the mold after the part is formed.

The term "plug" as used herein refers to a mold for forming a composite part, the mold having a predominantly convex shape.

A "composite" part as described in this invention defines a part which is made of plastic composite material with or without reinforcing material and can be laid-up, thermoformed, injection molded, roto-molded, vacuum molded, etc.

The term "register" as used herein refers to a recess or groove or other structure in a part which determines the position of another (second) part with a "mating register" with respect to the first part in a specific, unique way with close tolerance.

The term "common opening" as used herein refers to the combining of the bottom opening and the transom opening of a waterjet installation by the elimination of a substantial portion of the hull structure between intake duct, bottom and transom.

This invention is a waterjet-propelled marine vessel having a hull with a transom and a bottom, a jet pump, and an intake duct, the vessel including the following improvements. The transom and bottom have a common opening for intake duct installation, and the intake duct has an intake duct upper part and an intake duct lower part, whereby the intake duct upper part closes the common opening and the intake duct lower part fits into the intake duct upper part to form the intake duct.

In some embodiments, the intake duct upper part includes a register, the intake duct lower part includes a mating register, and the intake duct is formed by assembling the upper part and lower part such that the register and the mating register locate the parts in relation to one another. In preferred embodiments, the vessel bottom and transom and intake duct upper part are made of composite material.

In highly preferred embodiments, the intake duct upper part is a molded part having an inner upper wall and inner side walls, the walls all being free of undercuts, thereby enabling unencumbered release of the upper part from a mold. The intake duct upper part is formed over a mold plug and the intake duct upper part is integral with the vessel bottom and transom. In some embodiments, the vessel bottom and transom and intake duct upper part are made of composite material.

In other embodiments of the present invention, the intake duct upper part has a mounting flange about its periphery to effect the closing of the common opening and a shaft tube is integral with the intake duct upper part.

In yet another embodiment of the invention, the intake duct further includes a discharge end and a jet pump mounting surface at the discharge end to attach the jet pump.

In highly preferred embodiments of the present invention, the intake duct further includes an intake grid and the upper part further includes a suction end having an intake duct mount for attaching the intake grid covering the suction end. The intake duct lower part is a molded composite part, and the assembled intake duct is a molded integral part of the vessel hull.

BRIEF DESCRIPTION OF THE DRAWINGS

FIG. 1A is a perspective view of a conventional (PRIOR ART) waterjet intake duct installation.

FIG. 1B is a perspective view of the bottom and transom openings in the vessel of FIG. 1A.

FIG. 2A is a perspective view of a common bottom and transom opening in a vessel hull.

FIG. 2B is a perspective view of one embodiment of the intake duct of the present invention installed over the common opening of the vessel hull of FIG. 2A.

FIG. 6 is a perspective view of a vessel mold with an intake duct upper part plug in place.

FIG. 7 is a perspective view of a vessel mold with an intake duct upper part shell and intake duct lower part assembled therewith, the mold ready to be laid up to form the vessel.

DETAILED DESCRIPTION OF PREFERRED EMBODIMENTS

Figure 3A:
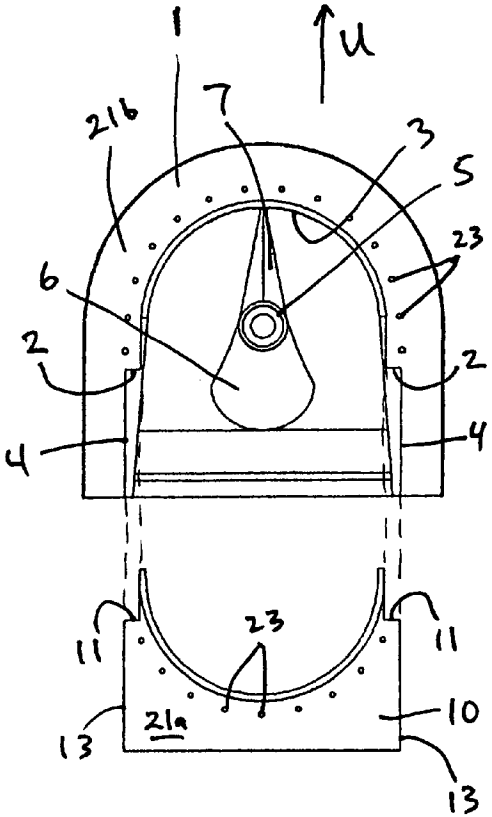
FIG. 3A is an exploded end elevation view of one embodiment of the inventive intake duct.

FIG. 2A is a perspective view of a marine vessel 200 with a hull 202 including a common opening 201, portions of which are in a vessel bottom protrusion 203*p* of a vessel bottom 203 and a vessel transom protrusion 205*p* of a transom 205. FIG. 2B is also a perspective view of vessel 200 with hull 202, further showing an intake duct upper part 1 placed over common opening 201 as seen in FIG. 2A. A mounting flange 25, including a transom mounting flange 25*a* and a bottom mounting flange 25*b*, is a part of intake duct upper part 1. The purpose of flange 25 is to enable the fastening and sealing of intake duct upper part 1 to transom protrusion 205*p* and vessel bottom protrusion 203*p*. Transom protrusion 205*p* serves to reinforce transom 205 and to provide a mating surface for transom mounting flange 25*a*. Vessel bottom protrusion 203*p* reinforces bottom 203 and provides a mating surface for bottom mounting flange 25*b*. A set of fasteners 211 secure intake duct upper part 1 to transom 205 and bottom 203. Fasteners 211 are easily accessible during installation of intake duct upper part 1.

Figure 3C:
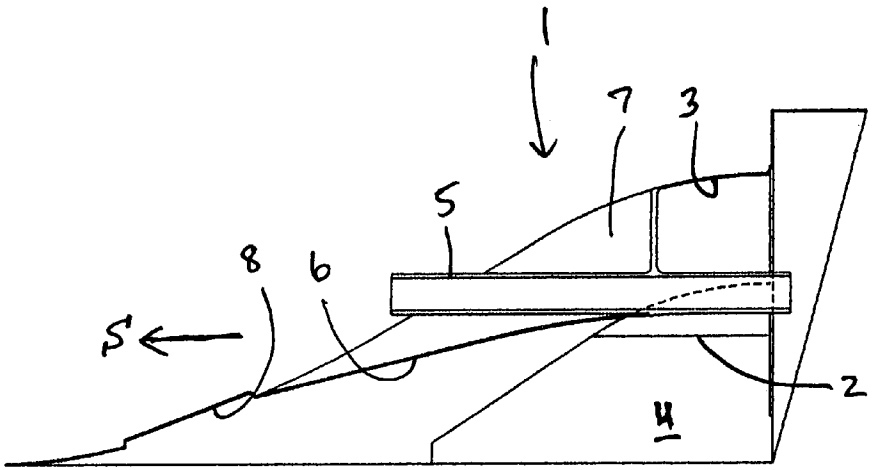
FIG. 3C is a side elevation section view of the intake duct of FIG. 3A.
Figure 3B:
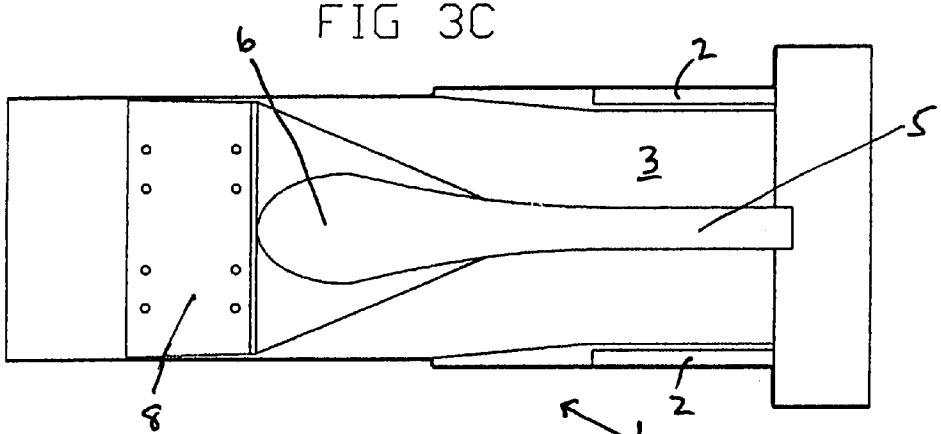
FIG. 3B is a bottom view of the intake duct of FIG. 3A.

FIG. 3A shows intake duct upper part 1 in end view with, in exploded view, an intake duct lower part 10. FIG. 3B shows intake duct upper part 1 in bottom view, and FIG. 3C shows intake duct upper part 1 in side elevation section. To secure a unique fixed position of the assembled upper and lower parts 1 and 10, two registers 2 are located in a pair of inner side walls 4 and a pair of mating registers 11 are located on intake duct lower part 10. Intake duct upper part 1 also includes an upper wall 3.

FIGS. 3A-3C show a shaft tube 5 with a strut 7 (not visible in FIG. 3B). Shaft tube 5 accommodates a drive shaft (not shown) of a jet pump 31 (shown in FIG. 5C) and a shaft tube fairing 6 to streamline shaft tube 5 in the stream of water flowing through an intake duct 20 (shown assembled in FIGS. 5A-5C). FIGS. 3B and 3C show an intake grid recess 8 formed to accommodate an intake grid 33 (shown in FIGS. 5B and 5C).

Figure 4C:
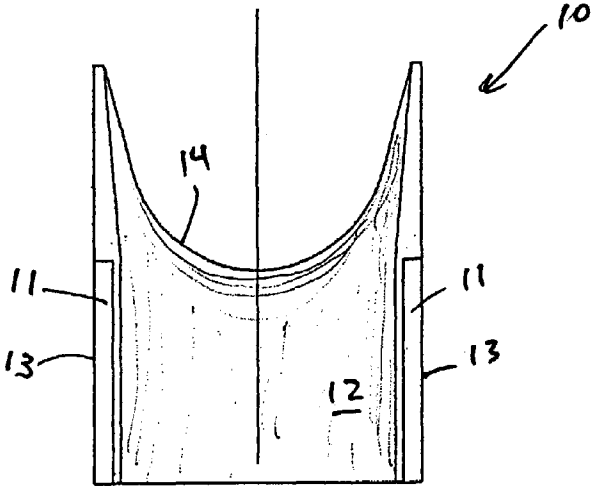
FIG. 4C is a plan view of the intake duct lower part of FIG. 4A.
Figure 4A:
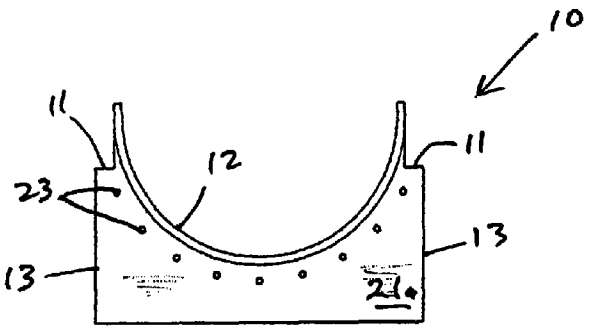
FIG. 4A is an end elevation view of the intake duct lower part.
Figure 4B:
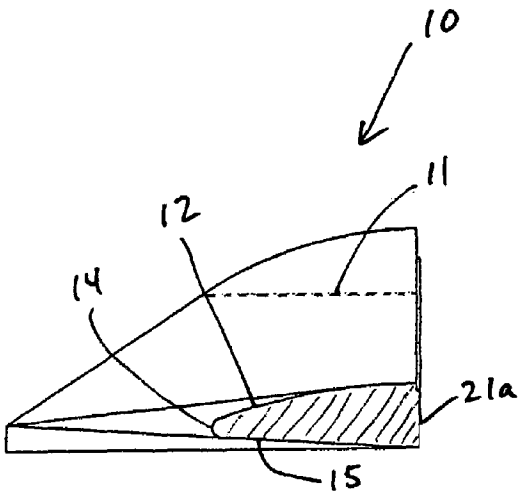
FIG. 4B is an side elevation section view of the intake duct lower part of FIG. 4A.

FIG. 4A shows an end view of intake duct lower part 10 with mating registers 11. FIG. 4B shows a side section of intake duct lower part 10, and FIG. 4C shows a plan view of intake duct lower part 10. Intake duct lower part 10 has a lower wall 12 which has a concave shape that fairs into an intake opening trailing edge 14 of an intake duct suction end 27 (see FIG. 5C). The side opposite lower wall 12 fairs into an intake bottom 15. As shown in FIG. 3A, the pair of inner side walls 4 are flat and tapered outwardly in a downward direction to ensure unencumbered release from a mold. Intake duct lower part 10 has no undercuts and can be molded with uncomplicated tooling.

Figure 5A:
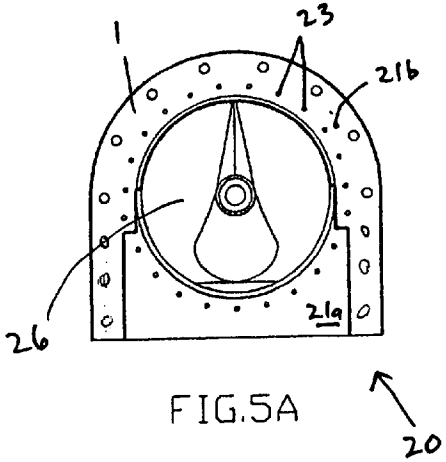
FIG. 5A is an end elevation view of an assembled intake duct.
Figure 5C:
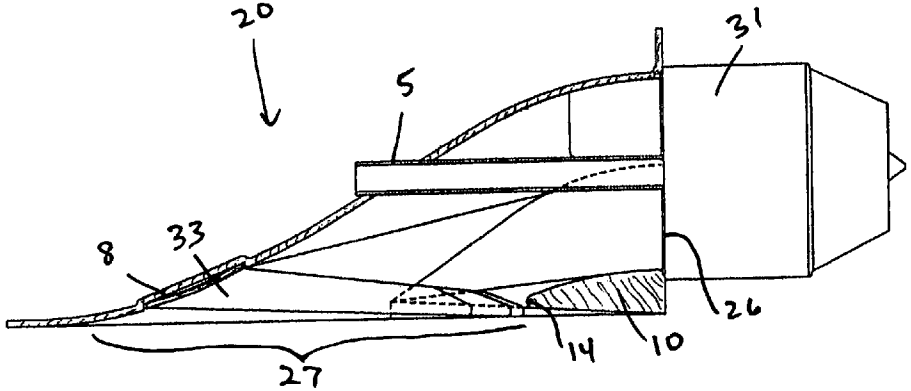
FIG. 5C is a side elevation partial section view of the assembled intake duct of FIG. 5A.
Figure 5B:
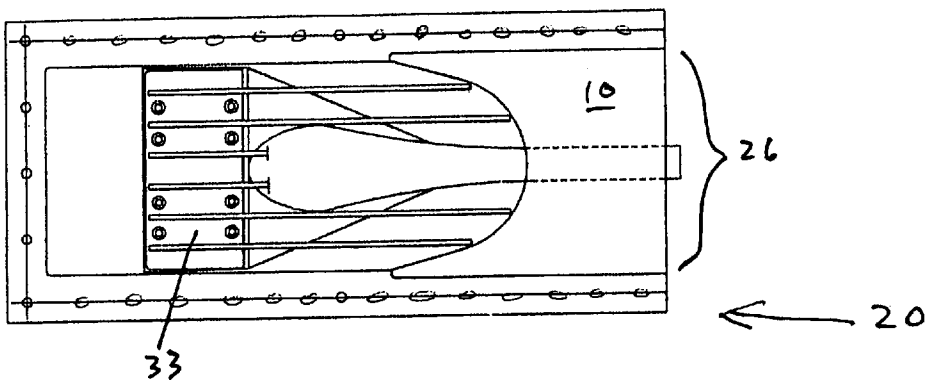
FIG. 5B is a bottom view of the assembled intake duct of FIG. 5A.

As shown in FIG. 5A, intake duct 20 is formed when intake duct upper part 1 and intake duct lower part 10 are joined along registers 2 and mating registers 11. Side surfaces 13 and inner side walls 4 constitute mating surfaces when intake duct 20 is assembled.

Upper wall 3 and inner side walls 4 form the inner shape of intake duct upper part 1 of intake duct 20. Upper wall 3 is curved and intersects with registers 2 and connects with inner side walls 4, creating an inverted U-shaped form. This form can be produced on a mold (not shown) allowing a release from this mold in an upward direction U or in a sideways direction S without hindrance, since no undercut is present and no part of the mold interferes with the departure of intake duct upper part 1 in an upward or sideways direction. As shown in FIG. 3C, with shaft tube 5 installed, the release from a mold is only in sideways direction S.

When upper part 1 and lower part 10 are permanently joined together by suitable adhesive or fasteners (not shown), they form intake duct 20. They also form a duct flange 21 around a discharge end 26 of intake duct 20. Flange 21 includes lower flange portion 21*a* and upper flange portion 21*b*. A set of flange bolt holes 23 provide for the fastening of jet pump 31 to intake duct 20 at duct flange 21.

In a second embodiment shown in FIG. 6, a vessel mold 50 is provided with a plug 51 to allow the integral forming of intake duct upper part 1 with the vessel hull (not shown) as part of the fabrication process of a composite vessel. Intake duct lower part 10 and shaft tube 5 are installed to complete the intake duct (not shown in mold 50 of FIG. 6).

In a third embodiment as shown in FIG. 7, intake duct upper part 1 is formed with a thin layer of composite material, just thick enough to hold its shape, thereby forming intake duct upper part 1 as a shell 1*s*. Intake duct lower part 10 is joined to shell 1*s*, and the resulting assembly is placed in hull mold 50. The vessel is laid-up in mold 50 and over shell 1*s*, making shell 1*s* an integral part of the hull. When the hull is removed from mold 50, a completed intake duct is formed in place (not shown in mold 50 of FIG. 7).

The embodiments shown in FIGS. 6 and 7 appear to be very similar but contain important differences, as follows. When the hull is removed from mold 50 and plug 51 in direction U in FIG. 6, the hull has formed in it only intake duct upper part 1. A protrusion 52 on plug 51 provides for a socket for placement of a shaft tube (not shown). Intake duct lower part 10 and a shaft tube are installed to complete the installation. Plug 51 remains in mold 50 when the hull is removed from mold 50. In the embodiment of FIG. 7, shell 1*s* with shaft tube 5 installed becomes part of the hull and is removed from mold 50 with the hull. Further, intake duct lower part 10 are also integral with the hull upon removal from mold 50.

The invention claimed is:

1. A method of forming/installing an intake duct in a waterjet-propelled marine vessel including a hull molded of composite material, a jet pump and an intake duct having final thickness, comprising:

prefabricating an intake duct upper part having an upper wall and side walls all of less-than-final thickness, and an upper flange portion;

prefabricating a lower part having a lower flange portion;

placing the upper part in the mold; and thereafter contemporaneously molding the hull and over-molding the prefabricated upper part to form the final-thickness intake duct integral with the hull and including the prefabricated upper part.

2. The method of claim 1 further including placing the lower part adjacent to the upper part such that the flange portions are aligned.

3. The method of claim 2 wherein the placing of the lower part is before the molding step.

4. The method of claim 3 wherein the placing of the lower part adjacent to the upper part includes joining the upper and lower parts.

5. The method of claim 1 wherein the prefabricating of the upper part includes forming the upper part over a mold plug.

6. The method of claim 5 wherein the upper part is formed free of undercuts, thereby enabling unencumbered release of the upper part.

7. The method of claim 1 further including installing a shaft tube in the upper part.

8. The method of claim 1 wherein the prefabricating of the upper part includes adding a shaft tube.

9. The method of claim 8 wherein the shaft tube is integrally formed with the upper part.

10. The method of claim 1 wherein the prefabricating of the upper part includes forming an intake duct mount for installation of an intake grid.

* * * * *